United States Patent [19]

Williams

[11] 4,130,238

[45] Dec. 19, 1978

[54] FARE BOX

[76] Inventor: John B. Williams, 825A Madison St., Brooklyn, N.Y. 11221

[21] Appl. No.: 842,832

[22] Filed: Oct. 17, 1977

[51] Int. Cl.[2] ..... G07B 15/00

[52] U.S. Cl. ..... 232/7; 109/24.1

[58] Field of Search ..... 232/7-16; 109/24.1; 235/32

[56] References Cited

U.S. PATENT DOCUMENTS

| | | | |
|---|---|---|---|
| 2,960,377 | 11/1960 | Simjian | 109/24.1 X |
| 3,078,789 | 2/1963 | McGee | 109/24.1 |
| 3,667,485 | 6/1972 | Sesko | 232/7 X |
| 3,670,955 | 6/1972 | Dominick | 232/7 |

*Primary Examiner*—Roy D. Frazier
*Assistant Examiner*—Peter A. Aschenbrenner
*Attorney, Agent, or Firm*—Howard I. Podell

[57] ABSTRACT

A fare box for use in a public transport system fitted with a first slot in the upper section of the housing for receipt of coins and fitted with a second slot in the side of the housing for receipt of paper bills. A pair of engaged rollers are mounted in the housing adjacent the second slot with the rollers driven by a pulley from a motor for feeding paper bills, pushed into the slot, into the interior of the housing.

2 Claims, 3 Drawing Figures

FARE BOX

SUMMARY OF THE INVENTION

My invention is a fare box for use in a public transport system fitted with a first slot in the upper section of the housing for receipt of coins and fitted with a second slot in the side of the housing for receipt of paper bills. A pair of engaged rollers are mounted in the housing adjacent the second slot with the rollers driven by a pulley from a motor for feeding paper bills, pushed into the slot, into the interior of the housing.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
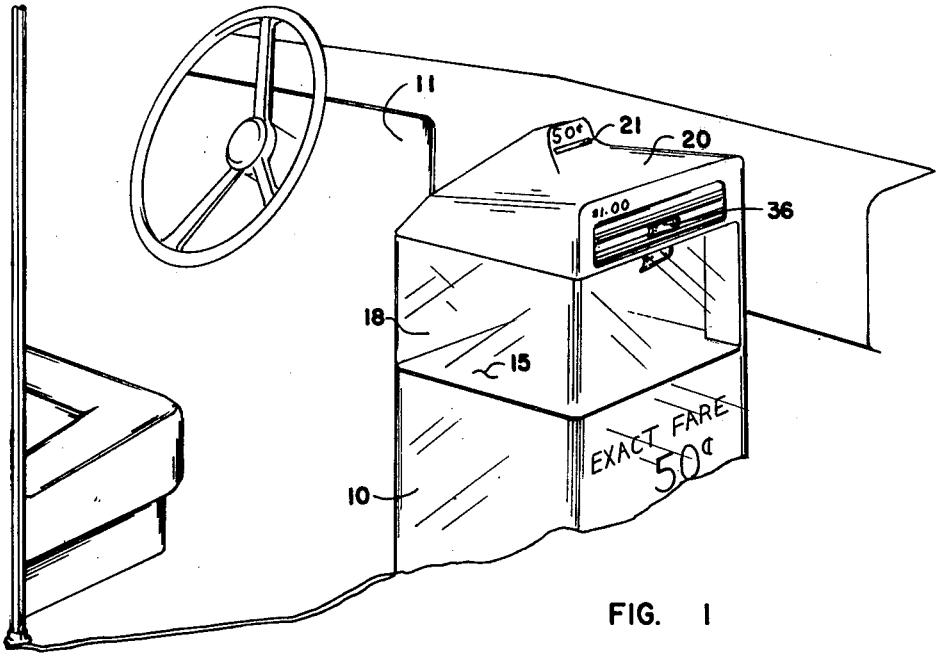
FIG. 1 is a perspective view of the invention in use.
Figure 2:
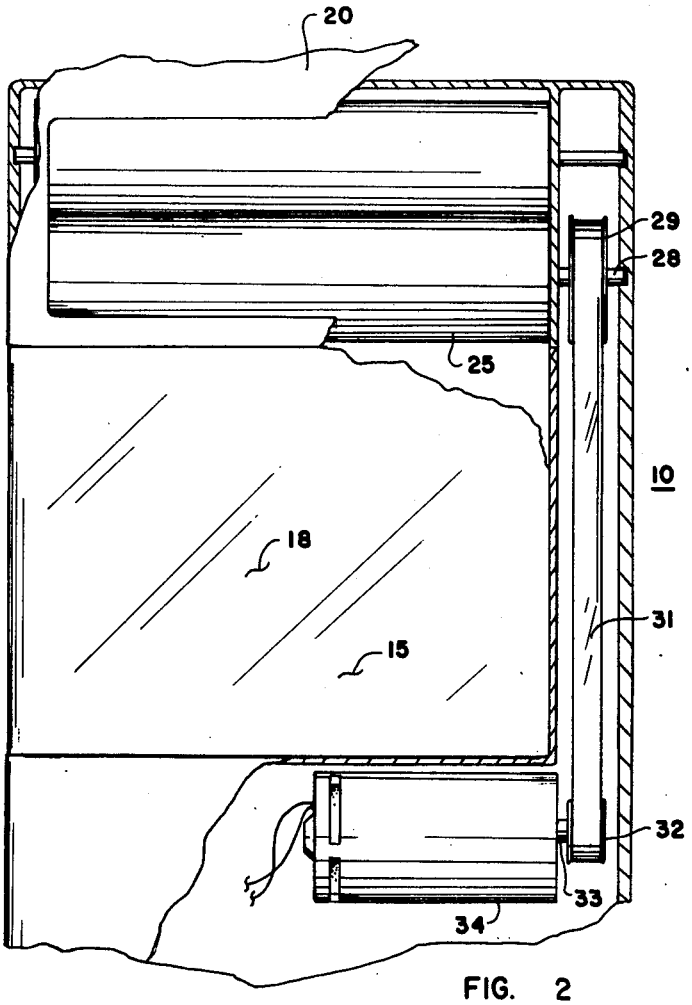
FIG. 2 is a front sectional view of the invention.
Figure 3:
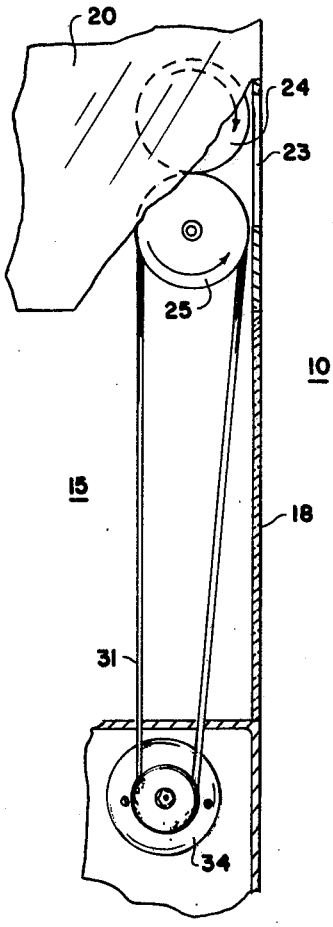
FIG. 3 is a side sectional view of the invention.

Turning now descriptively to the drawings, in which similar reference characters denote similar elements throughout the several views, FIGS. 1–3 illustrate the fare box 10 which may be mounted in a bus 11 for receipt of coins and of paper money bills. An upper interior chamber 15 of the box 10 is enclosed by transparent side walls 18, with a cover section 20 mounted above side walls 18 enclosing the top of chamber 15.

A through slot 21 is formed in the uppermost section of cover 20 for receipt of coins into the interior compartment 15.

A through opening 23 is formed in a side of the cover section of a width greater than that of a paper currency bill 36, with a pair of engaged rollers 24, 25 mounted in the box adjacent opening 23 so as to block opening 23.

One roller 25 is fixed to an axle 28 fitted with a pulley 29, with a belt 31 on pulley 29 driven by a pulley 32 on the drive shaft of a motor 34.

Motor 34 may be controlled by a remote switch operated by the driver of the bus 11, or a limit switch may be mounted so as to be actuated when a bill 36 is positioned in opening 23.

Rollers 24 and 25 are normally rotated by motor to draw a bill through the opening 23 and between rollers 24, 25 into chamber 15.

The driver of the bus 11 may inspect the bill 36 engaged by rollers 24, 25 through one of the transparent side walls 18 as it is fed into the chamber by rollers 24, 25 with the speed of the rollers set so as to provide time for such inspection.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A fare collection box fitted with transparent side walls that enclose the sides of an interior collection chamber, so that all the sides of said chamber are transparent, with a cover fitted to said side walls, said cover formed with a first opening in the form of a slot for admittance of coins into the said interior chamber and said cover formed with a second opening of a size to admit an unfolded paper bill of currency, said second opening blocked on the interior of said cover by a pair of engaged rollers, together with motorized drive means to rotate said rollers so as to engage and draw in a paper currency bill through said opening into said chamber.

2. The box as described in claim 1 mounted in a bus.

* * * * *